US005103863A

United States Patent [19]

Powers

[11] Patent Number: 5,103,863

[45] Date of Patent: Apr. 14, 1992

[54] INLET DISTRIBUTORS AND OUTLET COLLECTORS THAT ARE RATE INSENSITIVE

[75] Inventor: Maston L. Powers, Oklahoma City, Okla.

[73] Assignee: Conoco Inc., Ponca City, Okla.

[21] Appl. No.: 749,017

[22] Filed: Aug. 23, 1991

Related U.S. Application Data

[63] Continuation of Ser. No. 450,349, Dec. 12, 1989, abandoned.

[51] Int. Cl.[5] ..... E03B 11/00

[52] U.S. Cl. ..... 137/561 A; 137/575; 137/576; 137/592

[58] Field of Search ..... 137/561 A, 575, 576, 137/592

[56] References Cited

U.S. PATENT DOCUMENTS

| | | | |
|---|---|---|---|
| 1,244,704 | 11/1917 | Coburn | 137/561 A |
| 2,196,858 | 4/1940 | Gleason | 137/561 A |
| 3,899,000 | 8/1975 | Ohlswager et al. | 137/561 A |
| 4,441,902 | 4/1984 | Jardine | 62/183 |
| 4,505,879 | 3/1985 | Lhonore et al. | 137/561 A |

FOREIGN PATENT DOCUMENTS 213606 9/1964 Fed. Rep. of Germany .

*Primary Examiner*—A. Michael Chambers

[57] ABSTRACT

A fluid handling system includes a vessel having an inlet and an outlet. A first fluid transfer device is associated with the inlet, and a second is associated with the outlet. The fluid transfer devices substantially reduce short-circuiting of fluid flow through the vessel between the inlet and outlet independently of a fluid flow rate through the vessel while continuously transferring fluid through the inlet and the outlet. Each of the fluid transfer devices includes a plurality of hydraulically parallel flow passages defined therein. The flow passages communicate the interior of the vessel with either the inlet or the outlet. The flow passages have substantially identical flow characteristics such that for any differential pressure across all of the passages of one device the passages have substantially equal fluid flow rates therethrough. Each fluid transfer device is constructed so as to provide a substantially uniform differential pressure across all of its flow passages independently of the flow rate through the vessel, and for thus continuously flowing fluid through all of its flow passages at substantially equal flow rates.

18 Claims, 4 Drawing Sheets

INLET DISTRIBUTORS AND OUTLET COLLECTORS THAT ARE RATE INSENSITIVE

This is a continuation of application Ser. No. 07/450,349 filed Dec. 12, 1989, now abandoned.

BACKGROUND OF THE INVENTION

1. Field Of The Invention

The present invention relates generally to fluid handling systems, and more particularly to inlet distributors and outlet collectors for fluid containing vessels which substantially reduce short-circuiting of fluid flow through the vessel independently of a fluid flow rate through the vessel.

2. Description Of The Prior Art

In many process vessels it is desirable to minimize short-circuiting of fluid flow directly between an inlet and outlet, and to make the fluid flow rate as uniform as possible throughout the volume of the vessel.

The typical approach of the prior art to minimizing short-circuiting is to provide an inlet distributor and/or an outlet collector which includes a header system having a plurality of openings therein distributed across the cross section of the vessel. Typical examples of such systems are seen in U. S. Pat. Nos. 3,141,000 to Turner, and 4,406,789 to Brignon.

Such systems can be effective when the flow rate through the vessel is capable of being maintained at a design rate. These systems are much less effective, however, if the flow rate through the vessel drops substantially below that for which the header system is designed. At substantially lower flow rates, the fluid flow will be primarily through openings closest to the inlet and outlet.

U. S. Pat. No. 4,029,584 to Takemoto discloses an intermittent flowing system which has a collector pipe with a plurality of similar branch pipes communicating the collector with the vessel interior. Pressure within the collector is intermittently varied to intermittently provide a uniform flow through the branch pipes. The Takemoto system is not capable of continuous flow.

SUMMARY OF THE INVENTION

The present invention provides a fluid handling system including a vessel having an inlet and an outlet. A first fluid transfer means is associated with one of the inlet and the outlet for substantially reducing short-circuiting of fluid flow through the vessel between the inlet and outlet independently of a fluid flow rate through the vessel while continuously transferring fluid through said associated one of said inlet and outlet.

The fluid transfer means includes a plurality of flow passages, and an associated control means. The plurality of flow passages are hydraulically parallel, and communicate the vessel and said associated one of said inlet and outlet. The flow passages have substantially identical flow characteristics such that for any differential pressure across all of the passages they have substantially equal fluid flow rates therethrough.

The control means provides a means for providing a substantially uniform differential pressure across all of the flow passages independently of the fluid flow rate through the vessel, and for continuously flowing fluid through all of the flow passages at substantially equal flow rates.

Various embodiments of the transfer means are provided for use either as an inlet distributor or an outlet collector on both pressurized and non-pressurized vessels. Preferably both an inlet distributor and outlet collector constructed in accordance with the present invention are used.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENT

Recognition Of The Problem

Figure 1:
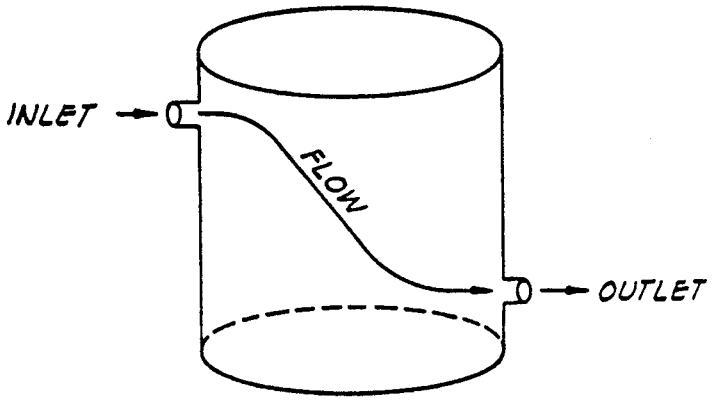
FIG. 1 PRIOR ART
FIG. 1 is a schematic illustration of a prior art vessel having short-circuiting between its inlet and outlet.

Hydraulic efficiencies of settling vessels and other process vessels are often low because of short-circuiting effects. Fluid flow takes the path of least resistance. Consequently there is a tendency for liquid to flow directly from a vessel inlet to the vessel outlet, thus causing the flow stream to bypass a majority of the vessel. This bypass or short-circuiting type of flow as exists in the prior art is schematically illustrated in FIG. 1.

If, for example, the vessel in question is a settling vessel, this results in a reduced period of time for the settling to take place. Similarly, for any other type of process vessel, the short-circuiting of fluid through the vessel results in a reduced period of time for the process, whatever it may be, to take place within the vessel. Thus, the efficiency of the vessel is very much limited.

A variety of inlet and/or outlet devices have been installed in vessels to reduce short-circuiting. The most effective of these provide numerous, well dispersed entrance and/or exit locations, i.e., holes, which have high flow resistances at design rate relative to the flow resistance through the plumbing connecting these entrance and/or exit locations and through the vessel itself.

Such designs improve flow distribution because the resistance to flow of any flow stream is the serial resistance of the inlet/exit hole, the resistance within the vessel plumbing, and that through the vessel. Consequently, flow distribution may be dramatically influenced if each hole has the same relatively high resistance to flow and/or the resistance and location of the hole is appropriately varied. Such prior art devices have three shortcomings. First, they rapidly lose effectiveness as the flow rate varies from the design rate. Second, the magnitude of the pressure loss across the dispersed holes of such vessels required for obtaining good distribution normally precludes their use as outlets for atmospheric pressure vessels. Finally, liquid must flow through relatively small, easily plugged holes.

Figure 2:
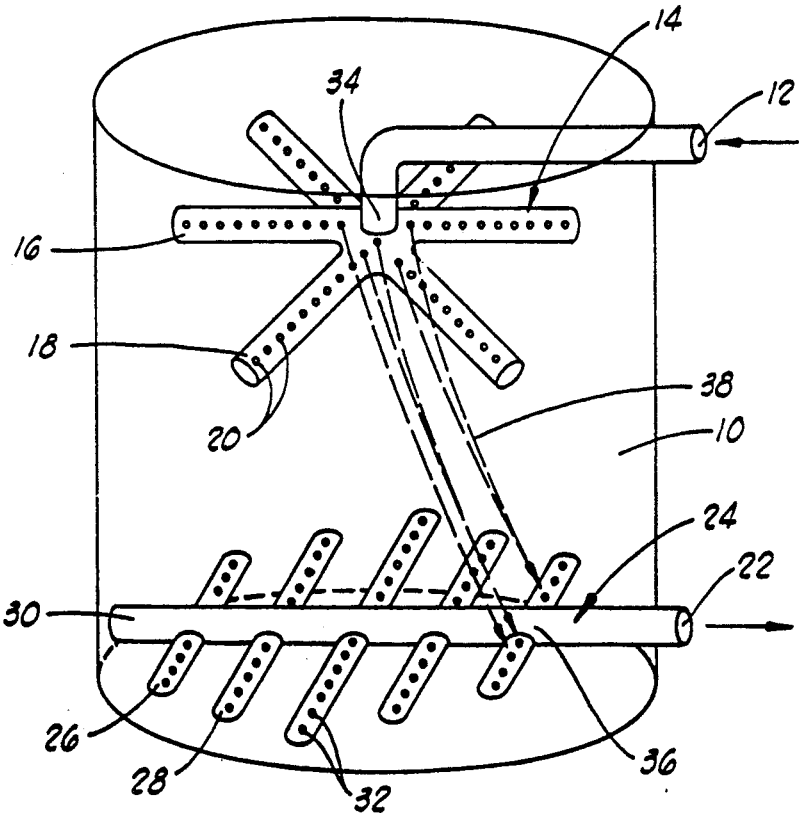
FIG. 2 PRIOR ART
FIG. 2 is a schematic illustration of another prior art vessel having an inlet distributor and an outlet collector which is rate sensitive, and illustrating the short-circuiting which can still occur when flow rates through the vessel are substantially below the design rate for which the distributor and collector system was designed.

FIG. 2 schematically illustrates two common configurations for such prior art devices that employ entrance/exit holes dispersed over the vessel cross section. In FIG. 2, a vessel is designated by the numeral 10. A vessel inlet 12 leads to an inlet distributor 14 in somewhat of a spider configuration having a plurality of distributor arms such as 16 and 18 each of which contain many small holes 20 through which fluid flows from the distributor 14 into the vessel 10.

A vessel outlet is indicated as 22, and is connected to an outlet collector 24 which has a plurality of collector arms such as 26 and 28 extending from a central collector header 30. Each of the collector arms carries a plurality of small collector openings 32 through which the fluid is received from the vessel 10 and directed to the outlet 22.

In order for such a system as illustrated in FIG. 2 to effect improved flow distribution through the vessel 10, the pressure loss across the entrance and exit holes 20 and 32 must be relatively large compared to the losses in the device plumbing, i.e., the conduits connecting the openings 20 and 32 to the inlets 12 and outlet 22, respectively, at all anticipated flow rates.

The design of devices for improving flow distribution such as those illustrated in FIG. 2, is feasible because head loss through the entrance or exit holes 20 or 32 follows the relationship described in Equation 1 below.

$$h_L = K\frac{v^2}{2g} \qquad \text{(Equation 1)}$$

In Equation 1, $h_L$ is head loss in feet, v is velocity in feet per second, g is the acceleration of gravity in feet per second squared, and K is the resistance coefficient of the hole 20 or 32 which is a unique dimensionless constant. It is apparent from examination of Equation 1 that head loss through an entrance or exit hole is proportional to discharge rate squared, and thus conversely discharge rate is proportional to the square root of head loss. Thus, a design for achieving reasonably uniform flow distribution must assume a specific minimum design flow rate so that $h_L$ will be large relative to the losses through the plumbing and vessel. As flow rate varies from the design rate, the flow distribution is distorted and if the rate is very much below design rate, flow will short-circuit from entrance holes near an inlet point 34 of the inlet distributor 14 to exit holes 32 nearest an outlet point 36 of the outlet collector 24. This short-circuiting flow is schematically illustrated in dashed lines in FIG. 2 as designated at 38.

This will occur because little or no flow will go through the more remote entrance or exit holes 30 or 32 due to the areal pressure variation within the device plumbing, i.e., the arms and header of the inlet distributor 14 and outlet collector 24. The magnitude of this pressure variation would become significant compared to the head loss through the entrance and outlet holes 30 and 32 at discharge rates below the design rate.

Thus, I have recognized that the need exists for inlet and outlet devices that will provide improved flow distribution regardless of flow rate. Such devices could dramatically improve the hydraulic efficiency of settling vessels and other process vessels.

The General Solution

I have determined that the problem of short-circuiting can be reduced and substantially eliminated by the following technique. First, the inlet or outlet device should provide substantially identical entrance and/or exit holes having substantially identical flow characteristics when operated at an equal differential head. These entrance and/or exit holes should be uniformly dispersed over a vessel cross section generally perpendicular to the direction of flow through the vessel.

Second, a means must be provided for controlling the differential pressure across the entrance and/or exit holes so that a substantially uniform differential pressure is provided across all of the entrance and/or exit holes, regardless of the flow rate through the vessel. This can be accomplished in one of two ways. One option is to isolate the internal pressure of the vessel from the fluid pressure in the inlet or outlet plumbing. The second option is to construct the inlet or outlet device such that the areal variation of pressure within the device is insignificant compared to the differential pressure across the entrance and/or exit holes.

With either technique, short-circuiting will be substantially eliminated and vessel hydraulic efficiency and operating flexibility will be vastly improved.

The specific embodiments illustrated and discussed below are particularly applicable to vessels in which the flow is essentially vertical. The devices described need not use entrance or exit holes that are so small that plugging from debris would result, and also they need not result in pressure losses of a magnitude that would preclude use of the outlet devices on atmospheric pressure vessels.

The Embodiment Of FIGS. 3–8

Figure 3:
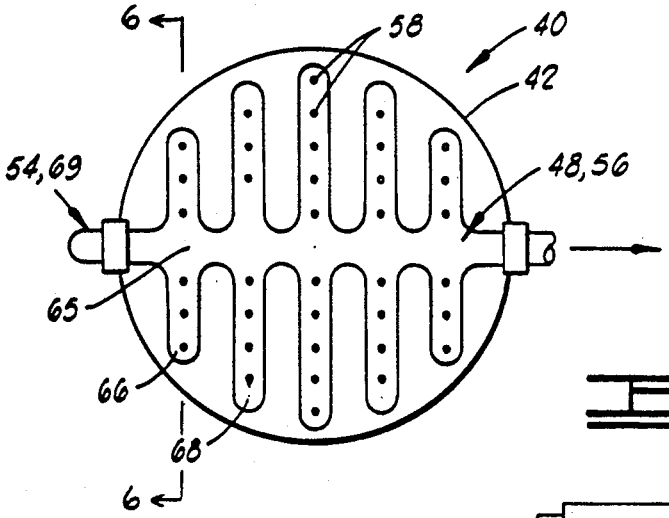
FIG. 3 is a plan view of a first embodiment of an outlet collector constructed according to the present invention.
Figure 4:
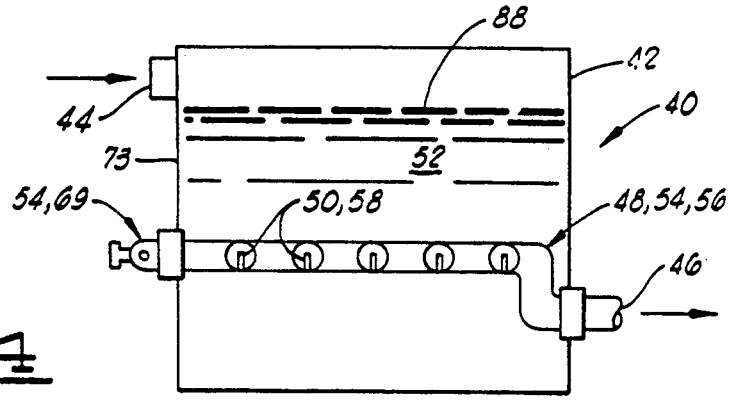
FIG. 4 is a side elevation view of the apparatus of FIG. 3.

FIGS. 3 and 4 are schematic plan and elevation views, respectively, of a fluid handling system generally designated by the numeral 40. The fluid handling system 40 includes a vessel 42 having an inlet 44 and an outlet 46. Although the inlet 44 is schematically illustrated as being a pipe coupling type inlet, it will be understood that the inlet 44 could in fact simply be an open-ended top of the vessel 42 into which fluid is discharged from an inlet supply line.

The fluid handling system 40 further includes a fluid transfer means generally designated by the numeral 48. The fluid transfer means 48 in the embodiment of FIGS. 3–8 is a collector associated with the outlet 46. As will be seen in the other embodiments, various ones of the fluid transfer means disclosed herein may be used with either the inlet or outlet and may be generally described as being associated with at least one of said inlet 44 and said outlet 46.

The fluid transfer means 48 provides a means for substantially reducing short-circuiting of fluid flow through the vessel 42 between the inlet 44 and outlet 46 independently of a fluid flow rate through the vessel 42, while continuously transferring fluid through the outlet 46 associated with the transfer device 48.

The fluid transfer means 48 can further be generally described as including a plurality of hydraulically parallel flow passages 50 defined in the transfer means 48. The flow passages 50 communicate an interior 52 of the vessel 42 and the outlet 46. The flow passages 50 have substantially identical flow characteristics such that for any differential pressure across all of said passages 50 they have substantially equal fluid flow rates therethrough.

The fluid transfer means 48 further includes a control means 54 for providing a substantially uniform differential pressure across all of said flow passages 50 independently of the fluid flow rate through the vessel 42. The control means 54 also provides a means for continuously flowing fluid through all of the flow passages 50 at substantially equal flow rates.

Each of the embodiments of the present invention illustrated in FIGS. 3–11 generally includes a vessel and a fluid transfer means, with the fluid transfer means including a plurality of flow passages and a control means as just generally described. Fluid transfer devices associated with an inlet are generally referred to herein as distributors or inlet distributors. Fluid transfer devices associated with an outlet are generally referred to herein as collectors or outlet collectors.

In the embodiment of FIGS. 3-8, the control means 54 can be further described as a means for isolating a fluid pressure in the interior 52 of vessel 42 from fluid pressure in the outlet 46.

The control means 54 includes a collector manifold 56 disposed in the vessel 42, and defining a collector interior 57. The plurality of flow passages 50 are defined by a plurality of flow tubes 58 extending through a bottom 60 of manifold 56. Each flow tube 58 has a lower end 62, which may also be referred to as an inside end 62 which is open to the inside or interior 52 of the vessel 42. Each flow tube has an upper end 64 which may also be referred to as an outside end 64 which is open to the interior of the manifold 56. The end 64 is referred to as an outside end, since relative to the vessel 42 it communicates directly with plumbing leading outside the vessel 42, rather than with the interior 52 of the vessel 42.

As seen in FIG. 3, the collector manifold 56 includes a central manifold conduit 65 and a plurality of branch manifold conduits such as 66 and 68. In FIG. 3, the position of the flow tubes 58 as distributed across the horizontal cross section thereseen of vessel 42 is schematically shown by the dots designated as 58. It will be understood that these are schematic illustrations only, and that the flow tubes 58 are in fact contained inside of the manifold 56.

The vessel 42 has a generally vertical direction of flow therethrough and has a horizontal cross section as seen in FIG. 3 which is generally perpendicular to the flow direction. As seen in FIG. 3, the flow passages or flow tubes 58 are substantially uniformly dispersed over the horizontal cross section of the vessel 42 so that the flow of fluid through the vessel 42 is substantially uniform across its horizontal cross section.

The control means 54 further includes a liquid level controller or liquid level control means 69 associated with the manifold 56 for controlling a liquid level indicated at 71 inside the manifold 56 to maintain the liquid level 71 below the upper ends 64 of the flow tubes 58.

Figure 5:
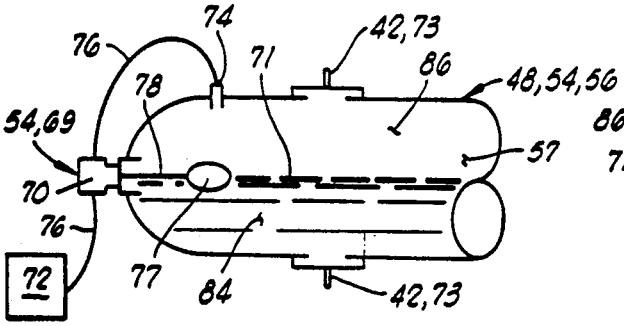
FIG. 5 is an enlarged view of a left end portion of the collector of FIG. 4.
Figure 6:
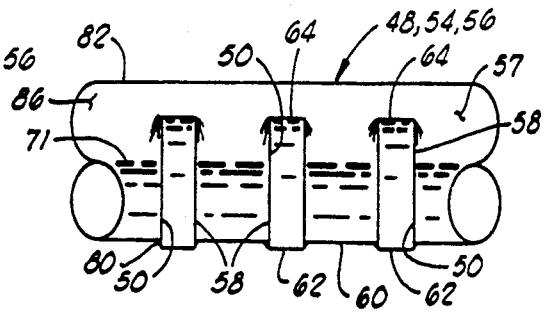
FIG. 6 is an enlarged partial elevation sectioned view taken along lines 6—6 of FIG. 3, schematically illustrating the design of the flow tubes in the collector of FIGS. 3-5.

The liquid level controller 69 is best seen in FIG. 5. In FIG. 5 a side wall 73 of the vessel 42 is partially shown. The liquid level controller 69 includes a gas valve 70 communicating a gas source 72 with a gas inlet 74 to manifold 56 through a gas supply line 76. The gas control valve 70 is actuated by a float 77 connected to valve 70 through a lever 78. The float 77 rides at the liquid level 71 to actuate the valve 70. Should the liquid level 71 tend to rise, additional gas would be admitted into the collector which would suppress the liquid level back to the desired level.

It may be seen in FIG. 4 that the manifold 56 is located at a higher elevation than outlet 46, which should be equipped with a vortex breaker. This trap arrangement prevents loss of gas from the manifold.

The manifold 56 may be fabricated from steel pipe in the configuration generally shown in plan view in FIG. 3. Holes are drilled in the bottom 60 of the pipe to receive the flow tubes 58 which are small vertical tubes typically up to one-inch nominal diameter pipe. The flow tubes 58 are of equal length and are inserted in the holes drilled in the bottom of the manifold 56 and then welded in place as generally indicated at 80 (see FIG. 6). These flow tubes 58 extend to near the top 82 of the large pipe from which the manifold 56 is constructed. As mentioned, the gas liquid interface or liquid level 71 is maintained at approximately mid-level of the manifold 56 by means of the float operated gas valve 70. The liquid 84 within the manifold 56 that has flowed into manifold 56 through the tubes 58 flows to the outlet 46, so that the liquid level 71 will slope from left to right in the schematic view of FIGS. 4 and 5. This differing level of liquid 71 within the manifold 56 does not, however, affect the pressure differential across the flow tubes 58. The flow tubes 58 are isolated from the differing liquid level throughout the manifold 56 due to the presence of the gas 86 within the manifold 56 which determines the pressure at the upper end 64 of the flow passages 58. Thus, the resistance effecting vessel flow distribution becomes the serial resistance of only the flow tubes and the vessel, the resistance within the plumbing having been completely isolated.

The pressure of gas 86 at all times will equal the hydrostatic pressure within the interior 52 of vessel 42 at a depth identical to the elevation of the top 64 of flow tube 68, plus any pressure superimposed upon the liquid surface 88 within vessel 42, and minus the loss due to flow through the flow tubes 58.

The liquid level 88 within tank 42 will be maintained by a tank liquid level controller (not shown) which may be of any one of numerous well known designs. The controller would regulate flow from the vessel outlet.

In order to provide each of the flow passages 50 with substantially identical flow characteristics, all of the flow tubes 58 are of substantially identical length and substantially identical inside diameter.

The manifold 56 must be installed level so that the lower ends 62 of all of the flow tubes 58 will be at identical elevations, and so that the upper ends 64 of all of the flow tubes 58 will be at identical elevations.

With the manifold 56 level, each flow tube 68 will have the same inlet pressure at its lower end 62, namely the hydrostatic pressure at the level of lower end 62 plus the superimposed pressure if any imposed at the liquid surface 88 within the vessel 42. Also, each flow tube 58 will have the same outlet pressure at its upper end 64, namely the pressure of gas 86. Consequently, the same differential pressure, ΔP, will be present across each flow passage 50 and thus the same head loss will be present through each flow passage 50. The head loss $h_L$ is determined by the following Equation 2:

$$h_L = \frac{\Delta P}{a} - L \qquad \text{Equation 2}$$

where $h_L$ equals head loss in feet, ΔP equals differential pressure in psi, a represents the liquid gradient in psi/ft and L is the length of the vertical tubes 58 in feet.

The flow through each flow tube 58 would obey the relationship expressed in Equation 3 below, in which A is the cross-sectional area of one tube 58 in square feet and Q is the flow through one tube 58 in cubic feet per second:

$$Q = A\sqrt{\frac{2gh}{K}L} \qquad \text{Equation 3}$$

Because all of the flow tubes 58 are constructed of the same size pipe and are of equal length, each tube will have the same flow characteristics, i.e., the same value of K, and the same value of $h_L$ as previously explained. Consequently flow rate through the various flow tubes 58 will be identical, regardless of the flow rate through the vessel 42. Thus a uniform outflow profile will be assured, and will enhance vessel hydraulic efficiency.

It is noted that the collector manifold 56 and attached equipment must be either heavy enough that buoyancy will not be a problem, or must be securely attached to the vessel 42.

The fluid transfer means 48 described above provides a uniform outflow profile regardless of the diameter of the flow tubes 58. The flow tubes 58 should be of sufficiently large diameter that plugging with debris will not be a problem and that resulting pressure loss will not be so large as to preclude the use of the device in an atmospheric pressure vessel. By atmospheric pressure vessel it is meant that atmospheric pressure is present at the upper liquid level 88 within the vessel 42.

It is noted, however, that the flow tubes 58 should not be of unnecessarily large diameter. That is undesirable because the friction loss through the flow tubes 58 will help to compensate for small errors in leveling of the manifold 56. Also, it is desirable for the flow resistance of each of the flow tubes 58 to be very large compared to the flow resistance through the vessel 42 itself.

Figure 7:
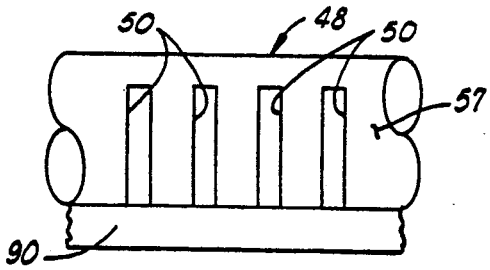
FIG. 7 is a view similar to FIG. 6 illustrating a vortex breaker below the lower end of the flow tubes.
Figure 8:
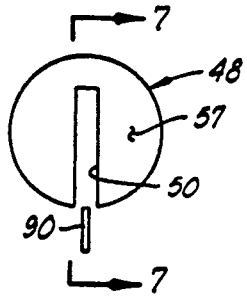
FIG. 8 is an end elevation view of the structure of FIG. 7.

FIGS. 7 and 8 show a vortex breaker means 90 associated with each of the flow passages 50 for reducing any vortex flow through the flow passages 50. As is apparent from FIGS. 7 and 8, the vortex breaker means 90 is a flat bar oriented in the plane of the longitudinal axes of the flow passages 50 and oriented adjacent the lower ends 62 of the flow tubes 58.

It is noted that although the fluid handling system 40 is particularly well adapted for use with an atmospheric pressure vessel, such as the vessel 42 illustrated, it may also be used with a pressurized vessel.

Figure 9:
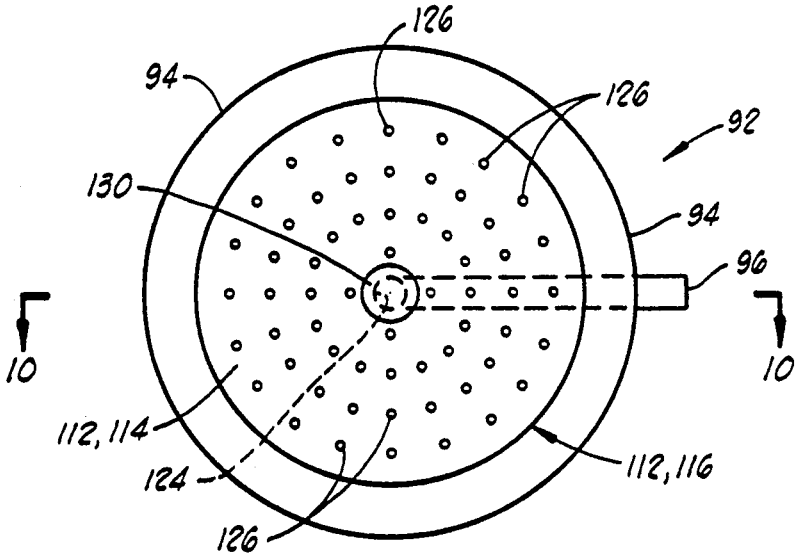
FIG. 9 is a schematic plan view of a second embodiment of the invention which is an inlet distributor shown in an atmospheric pressure vessel.
Figure 10:
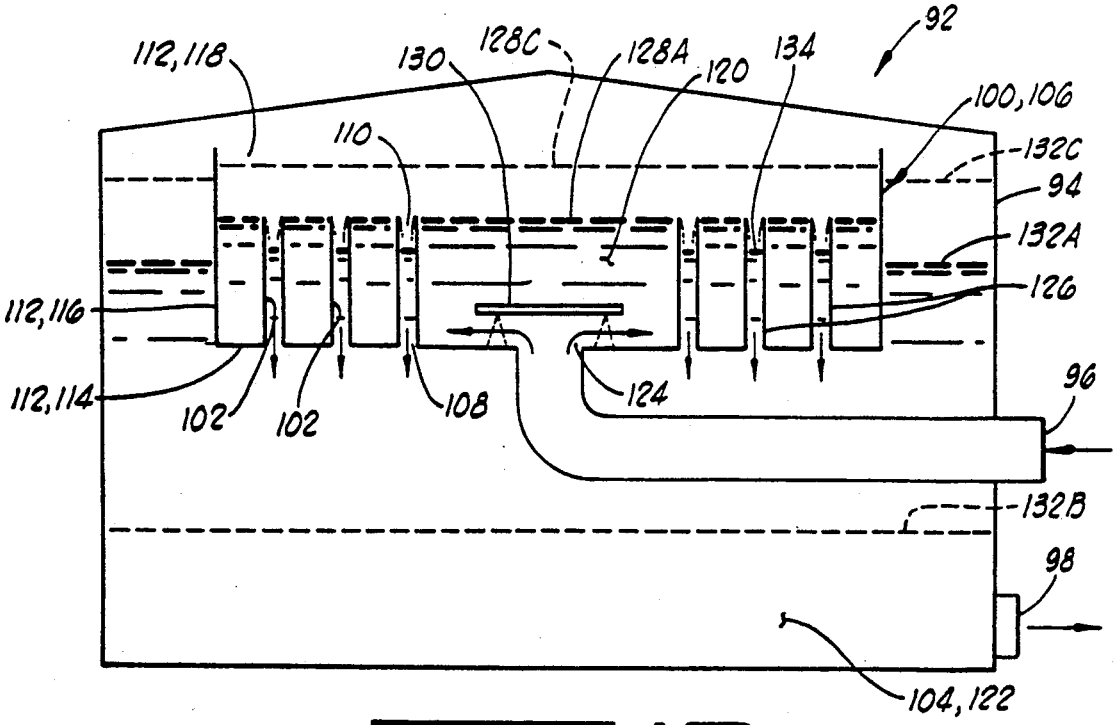
FIG. 10 is a schematic elevation sectioned view of the apparatus of FIG. 9 taken along lines 10—10 of FIG. 9.

The Embodiment Of FIGS. 9–10

FIGS. 9 and 10 illustrate a second embodiment of the invention. FIGS. 9 and 10 illustrate a fluid handling system 92. The system 92 includes a vessel 94 having an inlet 96 and an outlet 98. The fluid handling system 92 also includes a fluid transfer means 100 associated with the inlet 96 for substantially reducing short-circuiting of fluid flow through the vessel 94 between the inlet 96 and outlet 98 independently of the fluid flow rate through the vessel 94 while continuously transferring fluid through the inlet 96.

The fluid transfer means 100 includes a plurality of hydraulically parallel flow passages 102 defined therein. The flow passages 102 communicate an interior 104 of vessel 94 with the inlet 96. The flow passages 102 again have substantially identical flow characteristics such that for any differential pressure across all of the flow passages 102 they have substantially equal fluid flow rates therethrough.

The fluid transfer means 100 also includes a control means 106 for providing a substantially uniform differential pressure across all of the flow passages 102 independently of the fluid flow rate through the vessel 94. The control means 106 also provides a means for continuously flowing fluid through all of the flow passages 102 at substantially equal flow rates.

Each of the flow passages 102 has a lower or inside end 108 open to the interior 104 of vessel 94, and includes an upper outside end 110 open to the inlet 96.

The control means 106 is a means for maintaining fluid pressures at the outside ends 110 of all of the flow passages 102 having a magnitude of areal variation which is insignificant compared to the differential pressure across the flow passages 102. The control means 106 includes a cup-shaped divider 112 having a circular bottom 114, a cylindrical side wall 116 and an open top 118.

The cup-shaped divider 112 defines a distributor zone 120 separate from a main portion 122 of interior 104 of vessel 94. The flow passages 102 extend through the bottom 114 of divider 112, and have their inside ends 108 open to the main portion 122 of interior 104 of vessel 94, and have their outside ends 110 open to the distributor zone 120 which itself is communicated with the inlet 96.

The inlet 96 is communicated with the distributor zone 120 through a divider entrance 124 which is centrally located in the circular bottom 114 of cup-shaped divider 112.

The flow passages 102 are defined by vertically oriented flow tubes 126, all of which have their outside ends 110 at substantially identical elevations which defines an upper liquid level 128A within the cup-shaped divider 112.

A deflector 130 is located above the divider entrance 124 and below the upper ends 110 of flow tubes 126 to eliminate vertical velocity of the fluid entering divider entrance 124.

The liquid surface 128A within the cup-shaped divider 112 is essentially level because resistance to areal flow within the cup is insignificant. Since the flow tubes are identical and the cup 112 is installed level, the flow through each flow tube 126 will be equal. This is true because the fluid energy level at the top 110 of each flow tube 126 is essentially identical, that at the lower ends 108 of each flow tube 126 is identical, and each flow tube 126 has the same resistance to flow.

In FIG. 10, a liquid level in the vessel 94 is indicated at 132A below the upper ends 110 of flow tubes 126. The liquid level within the flow tubes 126 is indicated at 134 which is slightly above the liquid level 132A of vessel 94. This latter difference between liquid levels 132A and 134 represents the head loss of flow through the flow tubes 126.

It is noted that the fluid handling system 92 of FIGS. 9 and 10 would also function if the liquid level within vessel 94 was at the lower level 132B shown in dashed lines in FIG. 10, and a liquid level was not present within the flow tubes 96. It is preferable, however, to have a liquid level present in the tubes so that the head loss through the tubes can help to compensate for small errors in the leveling of bottom 114.

Also, if the liquid level within vessel 94 is maintained at a level 132C above the upper ends 110 of flow tubes 126, the uniform flow distribution would be preserved. However, vortex breakers would then need to be installed on the upper ends of the flow tube. The liquid level within the cup-shaped divider 112 would rise to level 128C shown in dashed lines in FIG. 10, and the uniform flow distribution would be preserved because the differential head across each flow tube 126 would still be essentially identical and flow would obey the relationship expressed in Equation 3.

Again it is noted that the liquid level in vessel 94, be it at 132A, 132B or 132C, must be controlled by an independent level controller (not shown) associated with the vessel 94.

It is also noted that the flow tubes 126 can be extended below the bottom 114 of cup-shaped divider 12 into the open vessel 94 to penetrate and oil/water interface if such is present within the vessel 94.

In FIGS. 3–8 a collector system was shown which could be associated with an outlet of an atmospheric pressure vessel, and in FIGS. 9 and 10 a distributor system has been shown which can be associated with the inlet of an atmospheric pressure vessel 10. It is, of course, preferable to utilize both the inlet distributor of FIGS. 9 and 10 and the outlet collector of FIGS. 3–8 on the same vessel for optimization of the uniformity of fluid flow through the vessel which is the ultimate goal of these systems.

Also, it should be noted that the systems of FIGS. 3–8 and FIGS. 9–10 can also be used on pressurized vessels.

Figure 11:
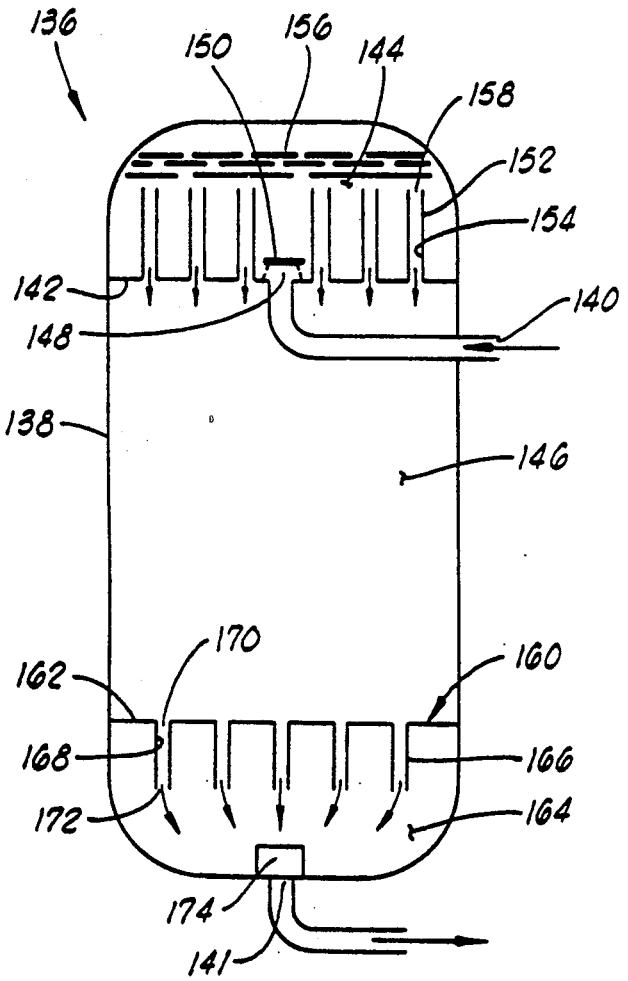
FIG. 11 is a schematic elevation sectioned view of a third embodiment of the invention having both an inlet distributor and an outlet collector.

The Embodiment Of FIG. 11

FIG. 11 shows a fluid handling system 136 including a vertically oriented pressure vessel 138 having an inlet 140 and having an outlet 141 located below the inlet 140.

The system 136 has a first fluid transfer means or distributor similar to the system 92 of FIG. 10, except that it has been modified for use in the pressure vessel 138.

The cup-shaped divider 112 has been replaced by a sealed distributor bulkhead divider 142 which defines a distributor zone 144 separate from a main interior portion 146 of the vessel 138. The solid bulkhead divider would seldom be applicable to an atmospheric pressure vessel because these are generally larger in diameter and constructed of thinner steel than pressurized vessels.

It is noted that the distributor zone 144 can also be described as being defined by a distributor cup wherein the bottom of the cup is the sealed bulkhead 142 and the side wall of the cup is defined as an integral part of the side wall of vessel 138.

The inlet 140 is communicated with the distributor zone 144 through a centrally located divider entrance 148. A deflector 150 is located above the divider entrance 148. A plurality of equal length, equal diameter flow tubes 152 define flow passages 154 extending through the divider 142 and communicating the distributor zone 144 with the main interior portion 146 of pressure vessel 138. The liquid level within distributor zone 144 is maintained at level 156 above the upper end 158 of flow tubes 152 which illustrates the same condition as that illustrated in FIG. 10 at liquid level 132C. The distributor zone also may be completely flooded and most commonly would be.

The system 136 also includes a second fluid transfer means 160 associated with the outlet 141. Second fluid transfer means 160 includes a collector bulkhead divider 162 defining a collector zone 164 separate from the main interior portion 146 of vessel 138. A second plurality of flow tubes 166 define collector flow passages 168 extending through the collector bulkhead divider 162. Each collector flow passage 168 has an inside end 170 open to the main interior portion 146 of vessel 138, and has an outside end 172 open to the collector zone 164. The collector zone 164 is communicated with outlet 141.

A plate type vortex breaker means 174 is located adjacent the outlet 141 for breaking any fluid vortex at the outlet 141.

Thus it is seen that the present invention readily achieves the ends and advantages mentioned as well as those inherent therein. While certain preferred embodiments of the invention have been illustrated and described for the purposes of the present disclosure, numerous changes in the arrangement and construction of components of the invention may be made by those skilled in the art, which changes are encompassed within the scope and spirit of the present invention as defined by the appended claims.

What is claimed is:

1. A liquid handling apparatus comprising:

a vessel having an interior;

a distributor cup having a bottom and a side wall;

an inlet means for supplying liquid to said cups;

a plurality of flow tubes having substantially equal lengths and substantially equal diameters, said flow tubes defining the only liquid flow passages extending through said bottom of said cup and communicating at lower ends of said flow tubes with said interior of said vessel, said flow tubes all having their upper ends at substantially identical elevations within said cup;

wherein said flow tubes are substantially uniformly distributed across a horizontal cross section of the distributor cup; and wherein a primary flow direction through said vessel is substantially vertical and through said flow tubes generally in a direction from the inlet to an outlet from the vessel;

such that turbulence and short circuiting of liquid flow through the vessel is minimized.

2. The apparatus of claim 1 wherein:

said vessel has an outlet located below said bottom of said distributor cup.

3. The apparatus of claim 1 wherein:

the distributor cup having a lip is situated at a locus near the top of the interior of the vessel and the open end of the cup faces upwardly;

said flow tubes are substantially uniformly distributed across a horizontal cross section of said vessel; and and the inlet means is sized such that the flow into the cup through the inlet means does not substantially exceed the flow through the flow tubes when the liquid level in the cup is below the lip thereof.

4. The apparatus of claim 1 wherein:

each of said flow tubes has a flow resistance which is very large compared to a flow resistance through said vessel.

5. The apparatus of claim 1 wherein:

said inlet means supplies liquid through said bottom of said cup at a substantially central location of said cup.

6. The apparatus of claim 5 further comprising:

a deflector located above said inlet.

7. The apparatus of claim 1 wherein:

said vessel is a pressurized vessel having a vessel wall; and said bottom of said distributor cup is a sealed bulkhead, and said side wall of said cup is defined by an integral part of said wall of said vessel.

8. A liquid handling apparatus comprising:

a vessel having an interior;

a horizontal divider separating said vessel interior into an upper portion and a lower portion;

a plurality of flow tubes having substantially equal lengths and substantially equal diameters, said flow tubes defining the only liquid flow passages extending through said divider and communicating said upper portion and said lower portion of said vessel interior, said flow tubes being substantially uniformly distributed across the horizontal cross section of the divider, wherein a primary flow direction through the vessel is substantially vertical and through the flow tubes, and wherein the flow tubes are substantially uniformly distributed across a horizontal cross section of the horizontal divider; and a vessel outlet communicated with said lower portion of said vessel interior such that turbulence and short circuiting of liquid flow through the vessel is minimized.

9. The apparatus of claim 8 wherein:

each of said flow tubes has a flow resistance which is very large compared to a flow resistance through said vessel.

10. The apparatus of claim 8 further comprising:

a vortex breaker disposed adjacent said outlet.

11. A liquid handling system comprising:

a vessel having an inlet and an outlet;

a liquid transfer means comprising a plurality of hydraulically parallel flow passages defined in said transfer means, said passages communicating said vessel and said one of said inlet and said outlet, said flow passages having substantially identical flow characteristics such that for any differential liquid pressure across all of said passages, they have substantially equal liquid flow rates therethrough and control means for providing a substantially uniform differential liquid pressure across all of said flow passages independently of said liquid flow rate through said vessel and for continuously flowing liquid through all of said flow passages at substantially equal flow rates;

said liquid transfer means substantially reducing short circuiting of liquid flow through said vessel between said inlet and said outlet independently of liquid flow rate through said vessel while continuously transferring liquid through said one of said inlet and said outlet wherein said liquid transfer means is a means for distributing liquid from said inlet into said vessel; and said control means includes a divider defining a distributor zone separate from a main portion of said interior of said vessel, said flow passages extending through said divider, said inside end of each of said passages being open to said main portion of said interior of said vessel and said outside end of each of said passages being open to said distributor zone, said distributor zone being communicated with said inlet.

12. The system of claim 11 wherein said inlet is communicated with said distributor zone through said divider at a divider entrance.

13. The system of claim 12 wherein said liquid transfer means further comprises:

said flow passages being vertically oriented with said outside ends being at substantially identical elevation; and a deflector located above said divider entrance and below said outside ends of said passages.

14. The system of claim 13 wherein:

said divider entrance is centrally located in said divider.

15. The system of claim 11 wherein:

said vessel is a pressure vessel; and said divider is a sealed bulkhead defining said distributor zone in said pressure vessel.

16. A liquid handling system comprising:

a vessel having an inlet and an outlet;

a liquid transfer means comprising a plurality of hydraulically parallel flow passages defined in said transfer means, said passages communicating said vessel and said one of said inlet and said outlet, said flow passages having substantially identical flow characteristic such that for any differential pressure across all of said passages, they have substantially equal liquid flow rates therethrough and control means for providing a substantially uniform differential liquid pressure across all of said flow passages independently of said liquid flow rate through said vessel and for continuously flowing liquid through all of said flow passages at substantially equal liquid flow rates;

said liquid transfer means substantially reducing short circuiting of liquid flow through said vessel between said inlet and said outlet independently of liquid flow rate through said vessel while continuously transferring liquid through said one of said inlet and said outlet wherein said liquid transfer means is a means for transferring liquid from said vessel to said outlet; and said control means includes a divider defining a collector zone separate from a main portion of said interior of said vessel, said flow passages extending through said divider and each having an inside end open to said main portion of said interior of said vessel and an outside end open to said collector zone, said collector zone being communicated with said outlet.

17. The system of claim 16 wherein said vessel is a pressurized vessel; and said divider is a sealed bulkhead defining said collector zone in said pressurized vessel.

18. The system of claim 16 further comprising: vortex breaker means adjacent to said outlet for breaking any liquid vortex at said outlet.

* * * * *